US008150072B2

(12) United States Patent
Ståhl

(10) Patent No.: US 8,150,072 B2
(45) Date of Patent: Apr. 3, 2012

(54) VIBRATION GENERATOR FOR ELECTRONIC DEVICE HAVING SPEAKER DRIVER AND COUNTERWEIGHT

(75) Inventor: Carl Ståhl, Malmö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 999 days.

(21) Appl. No.: 12/117,955

(22) Filed: May 9, 2008

(65) Prior Publication Data

US 2009/0279716 A1 Nov. 12, 2009

(51) Int. Cl.
*H04R 3/00* (2006.01)
*H04R 1/20* (2006.01)

(52) U.S. Cl. ..... 381/111; 381/117; 381/337; 381/345

(58) Field of Classification Search ..... 381/111, 381/117, 337, 345
See application file for complete search history.

(56) References Cited

U.S. PATENT DOCUMENTS

| | | | | |
|---|---|---|---|---|
| 4,131,180 | A | 12/1978 | Maeda | |
| 4,675,907 | A * | 6/1987 | Itagaki et al. | 381/152 |
| 5,850,460 | A * | 12/1998 | Tanaka et al. | 381/186 |
| 7,133,533 | B2 * | 11/2006 | Chick et al. | 381/349 |
| 7,911,327 | B2 * | 3/2011 | Lee | 340/407.1 |
| 2004/0087346 | A1 | 5/2004 | Johannsen et al. | |
| 2005/0018868 | A1 | 1/2005 | Chick et al. | |
| 2007/0195982 | A1 * | 8/2007 | Saiki et al. | 381/345 |
| 2008/0152180 | A1 * | 6/2008 | Tsai | 381/338 |

FOREIGN PATENT DOCUMENTS

| | | |
|---|---|---|
| DE | 198 23 363 | 7/1999 |
| DE | 20 2007 001267 | 3/2007 |
| EP | 0 340 435 | 11/1989 |
| EP | 0610669 | 8/1994 |
| EP | 1 551 203 | 7/2005 |
| EP | 1 788 835 | 5/2007 |
| WO | 2005/104608 | 11/2005 |
| WO | 2007049091 | 5/2007 |

OTHER PUBLICATIONS

International Search Report and Written Opinion for corresponding application No. PCT/IB2008/002983 dated Mar. 31, 2009.
Small; "Passive-Radiator Loudspeaker Systems Part I: Analysis," Journal of the Audio Engineering Society, vol. 12, No. 8; Oct. 1, 1974.
Small; "Passive-Radiator Loudspeaker Systems Part II: Synthesis," Journal of the Audio Engineering Society, vol. 22, No. 9; Nov. 1, 1974.
International Search Report and Written Opinion for corresponding application No. PCT/IB2010/000356, Feb. 23, 2010.

* cited by examiner

*Primary Examiner* — Luan C Thai
(74) *Attorney, Agent, or Firm* — Renner, Otto, Boisselle & Sklar, LLP

(57) ABSTRACT

A vibration generator for a portable electronic device includes a speaker driver and a counterweight retained by a housing to form a closed assembly. When a communications transmission is received by the electronic device, an input force signal is transmitted to the speaker driver to apply a force at a frequency substantially below its resonance frequency. Air sealed within the vibration generator between the speaker driver and the counterweight transmits the force signal inputted to the speaker driver to the counterweight with minimal dissipation, thereby causing the counterweight to vibrate at substantially the same frequency as that of the input force signal. The vibrations of the counterweight alert a user that a communications transmission is being received.

20 Claims, 3 Drawing Sheets

VIBRATION GENERATOR FOR ELECTRONIC DEVICE HAVING SPEAKER DRIVER AND COUNTERWEIGHT

TECHNICAL FIELD OF THE INVENTION

The technology of the present disclosure relates generally to portable electronic devices, and more particularly to an improved vibration generator for generating a vibration alert to a user of a portable electronic device, such as a mobile telephone.

DESCRIPTION OF THE RELATED ART

Portable electronic devices, such as mobile telephones, media players, personal digital assistants (PDAs), and others, are ever increasing in popularity. To avoid having to carry multiple devices, portable electronic devices are now being configured to provide a wide variety of functions. For example, a mobile telephone may no longer be used simply to make and receive telephone calls. A mobile telephone may also be a camera, an Internet browser for accessing news and information, an audiovisual media player, a messaging device (text, audio, and/or visual messages), a gaming device, a personal organizer, and have other functions as well.

With this increased functionality, mobile telephones are provided with a variety of alerts. An example of an alert is the common ringer or ringtone when one receives a telephone call. For a multifunction device, such as a mobile telephone with various communication capabilities, there may be a variety of alerts. For example, a mobile telephone may have different tones to alert a user to each of a telephone call, text message, picture message, and so on.

In many situations, however, a user may not desire an audible alert. For example, in theaters and restaurants, during meetings or presentations, and various other situations, an audible alert or ringtone may be a disturbance to others. Many mobile telephones, therefore, have a vibration feature in which the alert is a relatively inaudible physical vibration. When set to vibration mode, the user may "feel" an alert from the vibrations without there being significant sound that may disturb others. Vibration alerts may also be useful in loud settings in which a user may have difficulty hearing a ringtone or other audible alert. A vibration alert may provide an alternative or additional alert in such settings as well.

Conventional vibrator mechanisms include an electric motor that drives a mechanical, essentially mounted counterweight to produce the vibrations. For a practical output using an electric motor, the vibrations of the counterweight tend to be relatively high when considered in the context of how the vibrations may be felt by a user. At such typical frequencies, the vibrations create a bit of a "rumble" feeling that many users find uncomfortable. A somewhat lower frequency would be more desirable. Generating a lower, more comfortable frequency with an electric motor as compared to conventional frequencies, however, typically would require increasing the size of the counterweight, and commensurately other components of the electric motor. This increased size may be difficult to attain within the confines of the small size of a conventional mobile telephone. It remains difficult, therefore, to achieve more comfortable vibrating frequencies with an electric motor.

In addition, electric motors tend to have multiple metal components tied to a signal input, which may interfere with the electromagnetic signals being transmitted and received via the antenna. As a result, when placed in close proximity with the mobile telephone antenna, an electric motor vibrator may interfere with reception and performance. As stated above, however, given the size of the vibration mechanism, placement is limited. The vibration mechanism often is place in proximity to the antenna because the antenna also tends to be large relative to other telephone components. These two components, therefore, are often located nearby each other within a relatively large, cavity-forming portion of the mobile telephone housing, with other components and electronics occupying less spatial areas of the device. The interference issues further reduce the ability to increase the size of an electric motor vibrator to decrease the vibration frequency to make a more comfortable vibration.

SUMMARY

To improve the consumer experience with portable electronic devices having a vibration alert feature, there is a need in the art for an improved vibration mechanism. Embodiments of the present disclosure provide a vibration generator that does not employ an electric motor. Rather, the vibration generator includes a speaker driver and a counterweight in a closed assembly. When a communications transmission is received by the electronic device, an input signal generates a force that is transmitted to the speaker driver at a frequency substantially below its resonance frequency. As a result, the speaker driver vibrates somewhat, but not sufficiently to produce a significant audible sound. Air sealed within the closed assembly between the speaker driver and the counterweight acts much like a mechanical spring. Due to a relatively small size of the closed assembly, the speaker driver and air are substantially rigid and transmit the force inputted to the speaker driver to the counterweight with minimal dissipation, thereby causing the counterweight to vibrate at essentially the same frequency as the input force or signal. The vibrations of the counterweight may be felt by a user and alert the user that a communications transmission is being received.

With this configuration, vibration frequencies at more comfortable levels may be attained with a vibration generator of comparable size to that of a conventional electric motor vibrator. In addition, the described vibration generator has fewer metal components, and therefore would tend to interfere less with electromagnetic signals as compared to a conventional electric motor vibrator. Accordingly, interference effects with antenna performance may be reduced.

Therefore, according to one aspect of the invention, a vibration generator for use in a portable electronic device comprises a housing, a speaker driver mounted with respect to the housing, and a counterweight suspended with respect to the housing. The speaker driver receives an input force signal causing the speaker driver to apply a force to an air medium surrounded by the housing, such that the input force is transmitted through the air medium to cause the counterweight to vibrate.

According to one embodiment of the vibration generator, a resonance frequency of the speaker driver is greater than a frequency of the vibrations of the counterweight.

According to one embodiment of the vibration generator, the frequency of the vibrations of the counterweight is less than 200 Hz.

According to one embodiment of the vibration generator, the frequency of the vibrations of the counterweight driver is 160 Hz or less.

According to one embodiment of the vibration generator, the resonance frequency of the speaker driver is at least 600 Hz.

According to one embodiment of the vibration generator, the resonance frequency of the speaker driver is at least 800 Hz.

According to one embodiment of the vibration generator, the vibration generator is a closed assembly and transmits the forced inputted to the speaker driver through the air medium to the counterweight such that the speaker driver and the counterweight vibrate at substantially the same frequency.

According to one embodiment of the vibration generator, the vibration generator has a volume that is less than three cubic centimeters.

According to one embodiment of the vibration generator, the counterweight is suspended by a flexible membrane.

According to one embodiment of the vibration generator, the input force signal is an electrical signal inputted to the speaker driver.

Another aspect of the invention is an electronic device comprising a communications circuit for receiving a communications transmission, a vibration generator comprising a housing, a speaker driver mounted with respect to the housing, and a counterweight suspended with respect to the housing, and a controller configured to detect the received communications transmission and generate an input force signal to the speaker driver. The force inputted to the speaker driver is transmitted through an air medium surrounded by the housing of the vibration generator to cause the counterweight to vibrate to alert a user of the received communications transmission.

According to one embodiment of the electronic device, a resonance frequency of the speaker driver is greater than a frequency of the input force signal generated by the controller.

According to one embodiment of the electronic device, the frequency of the input force signal is less than 200 Hz.

According to one embodiment of the electronic device, the frequency of the input force signal is 160 Hz or less.

According to one embodiment of the electronic device, the resonance frequency of the speaker driver is at least 600 Hz.

According to one embodiment of the electronic device, the resonance frequency of the speaker driver is at least 800 Hz.

According to one embodiment of the electronic device, the vibration generator is a closed assembly and transmits the force inputted to the speaker driver through the air medium to the counterweight such that the speaker driver and the counterweight vibrate at substantially the same frequency.

According to one embodiment of the electronic device, the vibration frequency of the speaker driver and the counterweight is substantially the same as the frequency of the input force signal generated by the controller.

According to one embodiment of the electronic device, the counterweight is suspended by a flexible membrane.

According to one embodiment of the electronic device, the input force signal generated by the controller is an electrical signal inputted to the speaker driver.

According to one embodiment of the electronic device, the electronic device is a mobile telephone.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

It should be emphasized that the terms "comprises" and "comprising," when used in this specification, are taken to specify the presence of stated features, integers, steps or components but do not preclude the presence or addition of one or more other features, integers, steps, components or groups thereof.

DETAILED DESCRIPTION OF EMBODIMENTS

Figure 1:
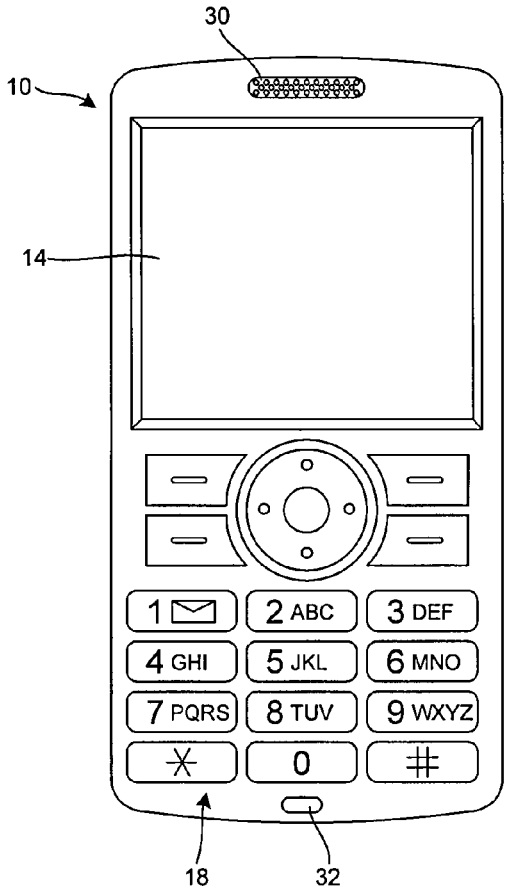
FIG. 1 is a schematic view of a mobile telephone as an exemplary electronic device for use with the described vibration generator.

Embodiments of the present invention will now be described with reference to the drawings, wherein like reference numerals are used to refer to like elements throughout. It will be understood that the figures are not necessarily to scale.

The following description is made in the context of a conventional mobile telephone. It will be appreciated that the invention is not intended to be limited to the context of a mobile telephone and may relate to any type of appropriate electronic device that employs alerts, and specifically for which a vibration alert may be appropriate. Examples of such devices include a computer, a media player, a gaming device, a pager, a personal digital assistant (PDA), or any portable communication apparatus or the like.

Figure 2:
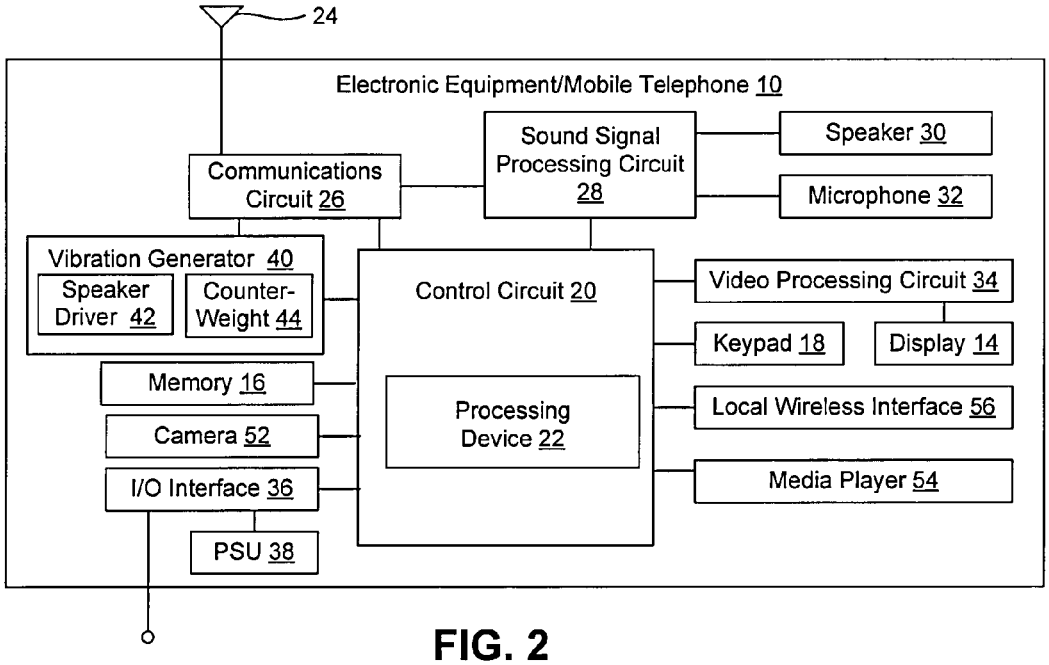
FIG. 2 is a schematic block diagram of operative portions of the mobile telephone of FIG. 1.

FIG. 1 is a schematic diagram depicting an exemplary mobile telephone 10, and FIG. 2 is a schematic diagram of operative portions of the mobile telephone of FIG. 1. Although the exemplary mobile telephone is depicted in FIG. 1 as having a "block" or "brick" configuration, the mobile telephone may have other configurations, such as, for example, a clamshell, pivot, swivel, and/or sliding cover configuration as are known in the art.

The mobile telephone 10 may include a primary control circuit 20 that is configured to carry out overall control of the functions and operations of the mobile telephone 10. The control circuit 20 may include a processing device 22, such as a CPU, microcontroller or microprocessor. The control circuit 20 and/or processing device 22 may comprise a controller that may execute program code embodied within the mobile telephone to control the various device functions. It will be apparent to a person having ordinary skill in the art of computer programming, and specifically in application programming for cameras, mobile telephones or other electronic devices, how to program a mobile telephone to operate and carry out logical functions associated with mobile telephone 10. Accordingly, details as to specific programming code have been left out for the sake of brevity. Also, while the code may be executed by control circuit 20 in accordance with an exemplary embodiment, such controller functionality could also be carried out via dedicated hardware, firmware, software, or combinations thereof.

The mobile telephone 10 includes a communications circuit 26 that enables the mobile telephone 10 to establish a call and/or exchange signals with a called/calling device, typically another mobile telephone or landline telephone, or another electronic device. The mobile telephone 10 also may be configured to transmit, receive, and/or process data such as text messages (e.g., colloquially referred to by some as "an SMS," which stands for short message service), electronic mail messages, multimedia messages (e.g., colloquially referred to by some as "an MMS," which stands for multimedia message service), image files, video files, audio files, ring tones, streaming audio, streaming video, data feeds (including podcasts) and so forth.

The communications circuit 26 also may include radio circuitry for coupling to an antenna 24. The radio circuitry of the communications circuit 26 includes a radio frequency transmitter and receiver for transmitting and receiving signals via the antenna 24 as is conventional. The mobile telephone 10 further includes a sound signal processing circuit 28 for processing audio signals transmitted by and received by the communications circuit 26. Coupled to the sound processing circuit are an audible speaker 30 and microphone 32 that enable a user to listen and speak via the mobile telephone 10 as is conventional.

In an exemplary mode of operation, when the mobile telephone receives a telephone call, the call is processed through the communications circuit 26 in conjunction with the control circuit 20. The sound signal processing circuit 28 may be employed to generate an audible alert for the user through the audible speaker 30 or other tone generator. The alert may be a conventional telephone ringing, a customized ringtone, or other sound that may alert the user that an incoming call is being received. Similar audible alerts may be generated in response to any incoming communications transmission including an incoming data transmission, such as an incoming text message, picture message, or the like.

As stated above, however, there may be circumstances in which an audible alert may be undesirable, such as when an audible alert would be disturbing to those around the user. In addition, there may be circumstances in which an audible alert may not be sufficient, such as when a user is in a loud or crowded location rendering it difficult to hear an audible alert. In such circumstances, a vibration generator 40 may be employed to generate physical vibrations to alert the user to an incoming communications transmission, such as a telephone call or data transmission. The physical vibrations are substantially inaudible and therefore less likely to disturb others than an audible alert. In addition, because the vibrations provide a physical stimulus, a user may recognize the alert in situations in which it may be difficult to hear an audible alert.

FIG. 2 depicts operative portions of the vibration generator 40 in block diagram form. The vibration generator includes a speaker driver 42 and a counterweight 44. Generally, the vibration generator operates as follows. An input force signal is inputted to the speaker driver. The inputted force signal may be an electrical signal generated by the controller. The input force signal causes the speaker driver to in turn apply a force to an air medium enclosed within the vibration generator, and the force is transmitted from the speaker driver through the air medium to drive vibrations of the counterweight. A user feels the vibrations of the counterweight as a vibration alert.

Figure 3:
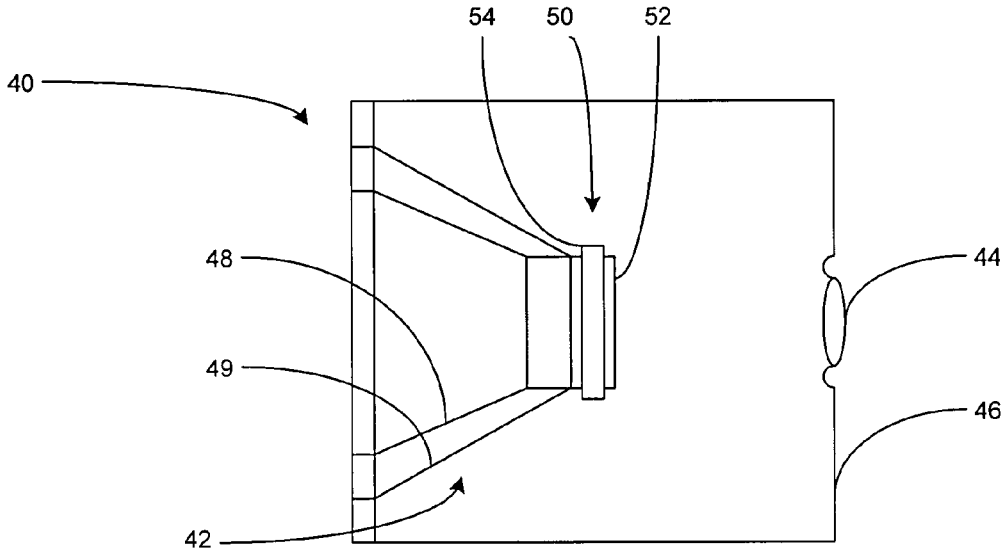
FIG. 3 is a schematic cross-sectional view of an exemplary vibration generator.

FIG. 3 is a schematic diagram depicting a cross-sectional view of the vibration generator 40. The vibration generator 40 forms a closed assembly that includes the speaker driver 42 and the counterweight 44, retained with respect to a rigid housing 46. The counterweight 44 may be suspended in an opening in the wall of the housing 46 opposite the speaker driver 42. It will be appreciated, however, that the configuration depicted in the figure is exemplary, and the positioning of the counterweight with respect to the speaker driver may be varied. For example, the counterweight may be suspended in a wall adjacent the speaker driver, or even suspended in the same wall on which the speaker driver is mounted. The vibration generator assembly may be sized and placed to fit within a mobile telephone casing as with conventional vibrators. The volume of the vibration generator, therefore, is on the order of one to three cubic centimeters. The assembly formed by the speaker driver, counterweight and housing preferably is air filled and substantially airtight for reasons described in more detail below.

The speaker driver 42 is, for the most part, similar to a conventional loudspeaker driver, and therefore its components are not described in great detail. The speaker driver 42 may be mounted with respect to the housing 46 in a manner comparable to a conventional loudspeaker. The speaker driver may include a conical shaped diaphragm 48, which is made of a flexible material and acts as a flexible membrane. The diaphragm is supported in a suspension frame 49 that is attached to the housing 46, but otherwise permits vibration of the diaphragm 48. The speaker driver also may include a signal converter 50 for receiving electrical force input signals, which may then be converted into a physical force to be applied by the speaker driver to the counterweight. The signal converter 50 may include a voice coil 52 and permanent magnet 54. Electrical input signal inputs may be provided through leads (not shown) to the voice coil 52. The permanent magnet 54 cooperates with the voice coil 52 to convert the electrical input signals to vibrations. Those skilled in the art will understand how a speaker driver converts electrical input signals into vibrations (e.g., waves in an air medium). Generally, when electrical input signals are applied to the voice coil, the voice coil acts as an electromagnet. Depending upon the polarity of the input signal, the voice coil may be attracted to or repelled by the permanent magnet 54. As the input signal varies at a given frequency, so do the attraction/repulsion forces between the voice coil and the magnet, causing the voice coil to vibrate. These vibrations are transmitted to the diaphragm in turn, which generates the vibration waves. As further described below, in the disclosed vibration generator 40 the resonance frequency of the speaker driver 42 should be substantially greater than the desired output vibration frequency (which substantially equals the frequency of the input force signal). When the resonance frequency is such, the speaker driver will remain substantially rigid and motionless, and will produce minimal audible sound. In this manner, the speaker driver applies the input force signal to the air enclosed within the vibration generator to drive vibrations of the counterweight 44.

Figure 4:
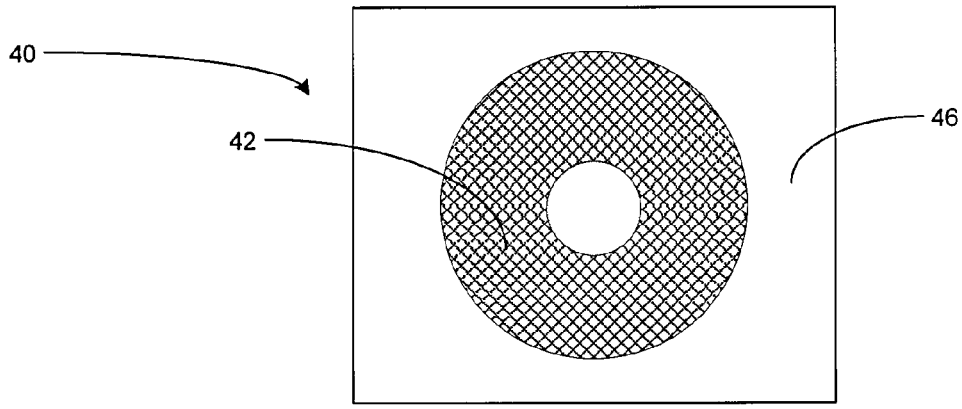
FIG. 4 is a schematic front view of the vibration generator of FIG. 3.

FIG. 4 depicts a schematic front view of the vibration generator 40. As shown in this view, the speaker driver 42 may be mounted with respect to the housing 46 such that the front face of the speaker driver 42 faces outward from the housing 46, but is positioned such that the vibration generator is closed and substantially airtight. The housing 46 may be made of any suitable material commonly used in loudspeaker designs. Such materials may include wood, rigid plastics, and the like. Metals are less preferred for the housing so as to minimize potential interference with the antenna. The speaker driver covers and seals a front aperture of the housing to maintain the closed assembly configuration of the vibration generator 40.

Figure 5:
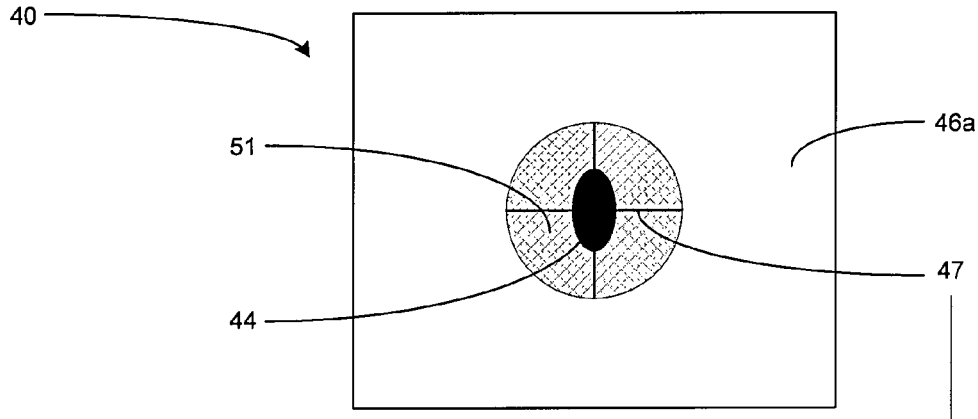
FIG. 5 is a schematic rear view of the vibration generator of FIG. 3.
Figure 6:
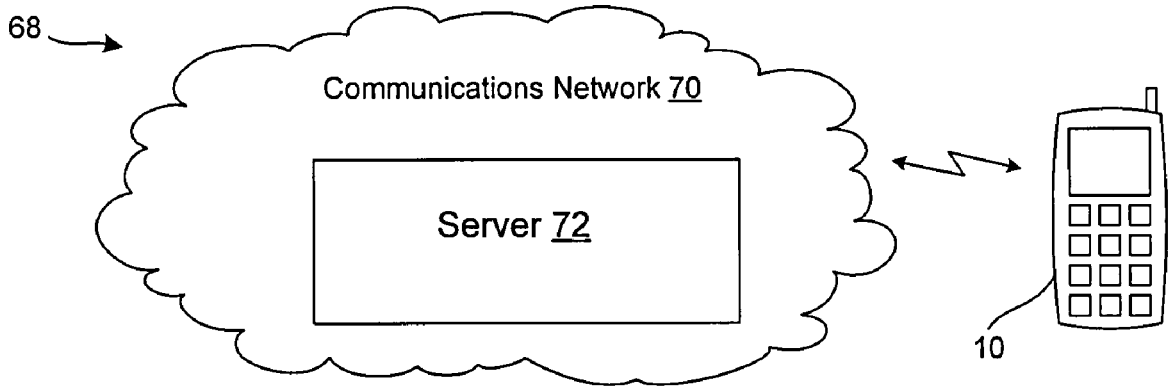
FIG. 6 is a schematic diagram of a communications system in which the mobile telephone of FIG. 1 may operate.

Referring again to FIG. 3, the vibration generator 40 also includes the counterweight 44 that is suspended with respect to the housing 46. The counterweight may be made of a metal, plastic, or similar rigid material. For example, a 3 mm oval shaped counterweight of iron or lead, has been found to work well to achieve a desirable range of vibration frequencies while accommodating the size constraints of a mobile telephone. FIG. 5 depicts a rear view of the vibration generator 40, which demonstrates an exemplary suspension of the counterweight 44 with respect to the housing 46. As shown in the exemplary embodiment of FIGS. 3 and 5, the counterweight 44 may be suspended in an opening in a wall 46*a* of the housing opposite the speaker driver, although, as stated above, the positioning of the counterweight relative to the speaker driver may be varied. The counterweight may be suspended in position by a suspension membrane 51 attached to the housing 46. Suspension membrane 51 may be made of a flexible material that permits movement of the counterweight 44, while maintaining the substantially airtight nature of the vibration generator 40. The suspension membrane may be made of a plastic film, paper-like webbed material, or other material similar to that used in speaker diaphragms. If a plastic film, the suspension membrane may be molded into the housing if made of a similar plastic material, the suspension membrane having a suitably small thickness to provide for flexibility. The suspension membrane 51 alternatively may be adhered to the housing by any suitable adhesive or epoxy. Similar adhesive materials may be used to embed the counterweight 44 within the suspension membrane. The suspension membrane 51 also may be configured to have a pocket that envelopes the counterweight and is closed around the counterweight during manufacture. The counterweight 44 also may be supported by supports 47, which may be made of a movable flexible plastic or wire-like material. The counterweight 44, suspension membrane 51, and supports 47 are configured to maintain the vibration generator 40 as a closed assembly. In practice, it is desirable for the suspension membrane 51 to be as small as possible so that the gravamen of the movement is that of the counterweight 44 rather than the suspension membrane.

The vibration generator 40 may operate as follows to generate vibrations to provide a physical alert to a user of an incoming communications transmission, such as a telephone call or data transmission. A user may set the mobile telephone to a "vibration mode" using a menu system or other conventional manner. In one embodiment, such as when a user does not wish to disturb others, the vibration mode may be selected in a manner that disables audible alerts. In other embodiments, such as when a user is concerned that an audible alert may not be heard, the vibration mode may be selected in a manner that provides a vibration alert in addition to an audible alert.

The control circuit 20 may comprise a controller for activating the vibration generator 40. For example, when a communications transmission is received, the incoming communications transmission may be detected by the control circuit 20. An input force signal may be generated by the control circuit 20. For example, the input force signal may be an electrical input vibration signal generated by the control circuit 20. Alternatively, vibration controller functions may be performed in whole or in part by the communications circuit 26. The input force signal may be transmitted from the controller to the signal converter 50 of the speaker driver 42. The input signal may have a desired frequency, which causes the speaker driver to generate in turn a force of substantially the same frequency as the input force signal. A vibration frequency (and therefore an input signal frequency) of less than 200 Hz, and preferably about 160 Hz, has been shown to provide enhanced comfort to a user. The resonance frequency of the speaker driver 42, therefore, should be substantially above 160 Hz. The result is that when an electrical input of 160 Hz is provided to the speaker driver, minimal audible sound emanates from the speaker driver. Given the size constraints of the mobile telephone, a speaker driver having a resonance frequency on the order of 600 to 800 Hz or higher may be employed, although other resonance frequencies may be employed provided that the resonance frequency is greater than the ultimate vibration frequency of the counterweight. At a resonance frequency of 600-800 Hz, the speaker driver produces essentially no audible sound from an input force signal on the order of 160-200 Hz.

Also as stated above, the vibration generator 40 is a closed assembly and substantially airtight. With the vibration generator 40 sized to fit a mobile telephone, at such size the air medium inside acts much like an "air spring". The speaker driver and air medium remain essentially rigid and motionless. As a result, the force inputted to the speaker driver 42 is transmitted through the air medium without significant dissipation to the movable counterweight 44, which vibrates at essentially the same frequency as that of the input force signal. Accordingly, in an exemplary embodiment intended for user comfort, an input force signal of approximately 160 Hz results in a vibration of the counterweight of approximately 160 Hz in turn.

Advantages of the described vibration generator will be apparent. For example, the described vibration generator may produce a vibration frequency at a lower, more comfortable frequency than a conventional electric motor vibrator of comparable size. To achieve a vibration frequency on the order of 160 Hz using a conventional electric motor vibrator, the motor and/or counterweight size would need to be increased beyond what is typically desired for a handheld electronic device. In addition, the described vibration generator has fewer metal components and thus is less prone to interfere with electromagnet fields than a conventional vibrator. The described vibration generator, therefore, would tend to produce less interference with the antenna and communications components than a conventional vibrator.

Although the vibration generator has been described as providing an alert function, it may have other uses as well. For example, vibrations may be used in connection with music, video, and other multimedia operations to enhance the entertainment experience.

Referring again to FIGS. 1 and 2, additional components of the exemplary mobile telephone 10 will now be described. For the sake of brevity, generally conventional features of the mobile telephone 10 will not be described in great detail herein.

Mobile telephone 10 has a display 14 that displays information to a user regarding the various features and operating state of the mobile telephone 10, and displays visual content received by the mobile telephone 10 and/or retrieved from a memory. The display 14 may be coupled to the control circuit 20 by a video processing circuit 34 that converts video data to a video signal used to drive the various displays. The video processing circuit 34 may include any appropriate buffers, decoders, video data processors and so forth. The video data may be generated by the control circuit 20, retrieved from a video file that is stored in a memory 16, derived from an incoming video data stream received by the communications circuit 26 or obtained by any other suitable method. In one embodiment, a visual alert may be displayed in addition to the vibration alert described herein.

A keypad 18 provides for a variety of user input operations. For example, keypad 18 typically includes alphanumeric keys for allowing entry of alphanumeric information such as telephone numbers, phone lists, contact information, notes, etc. In addition, keypad 18 typically includes special function keys such as a "send" key for initiating or answering a call, and others. Some or all of the keys may be used in conjunction with the display as soft keys. Keys or key-like functionality also may be embodied as a touch screen associated with the display 14. The keypad may be used to activate the vibration function described herein, such as by selection from a menu or by pushing a key dedicated to that function.

Mobile telephone 10 may include a camera function 52. The memory 16 may store various device functions as executable program code, as well as various media objects. The media objects may include digital photographs taken using the camera function 52. A media player 54 may be employed to play multimedia content stored in the memory 16, or obtained from an external source.

The mobile telephone 10 also may include a local wireless interface 56, such as an infrared transceiver and/or an RF adaptor (e.g., a Bluetooth adapter), for establishing communication with an accessory, another mobile radio terminal, a computer or another device. For example, the local wireless interface 56 may operatively couple the mobile telephone 10 to a headset assembly (e.g., a PHF device) in an embodiment where the headset assembly has a corresponding wireless interface.

The mobile telephone 10 also may include an I/O interface 36 that permits connection to a variety of I/O conventional I/O devices. One such device is a power charger that can be used to charge an internal power supply unit (PSU) 38. Mobile telephone 10 also may include a timer and a media player as are conventional.

Referring to FIG. 7, the mobile telephone 10 may be configured to operate as part of a communications system 68. The system 68 may include a communications network 70 having a server 72 (or servers) for managing calls placed by and destined to the mobile telephone 10, transmitting data to the mobile telephone 10 and carrying out any other support functions. The server 72 communicates with the mobile telephone 10 via a transmission medium. The transmission medium may be any appropriate device or assembly, including, for example, a communications tower (e.g., a cell tower), another mobile telephone, a wireless access point, a satellite, etc. Portions of the network may include wireless transmission pathways. The network 70 may support the communications activity of multiple mobile telephones 10 and other types of end user devices. As will be appreciated, the server 72 may be configured as a typical computer system used to carry out server functions and may include a processor configured to execute software containing logical instructions that embody the functions of the server 72 and a memory to store such software.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. A vibration generator for use in a portable electronic device comprising:

a housing;

a speaker driver mounted with respect to the housing; and a counterweight suspended with respect to the housing;

wherein the speaker driver receives an input force signal causing the speaker driver to apply a force to an air medium surrounded by the housing, and the speaker driver and air medium remain substantially rigid such that the input force is transmitted through the air medium with minimal dissipation to cause the counterweight to provide a vibration alert.

2. The vibration generator of claim 1, wherein a resonance frequency of the speaker driver is greater than a frequency of the received input force signal and the vibrations of the counterweight.

3. The vibration generator of claim 2, wherein the frequency of the vibrations of the counterweight is less than 200 Hz.

4. The vibration generator of claim 3, wherein the frequency of the vibrations of the counterweight is 160 Hz or less.

5. The vibration generator of claim 4, wherein the resonance frequency of the speaker driver is at least 600 Hz.

6. The vibration generator of claim 5, wherein the resonance frequency of the speaker driver is at least 800 Hz.

7. The vibration generator of claim 1, wherein the vibration generator is a closed assembly and transmits the force inputted to the speaker driver through the air medium to the counterweight such that the speaker driver and the counterweight vibrate at substantially the same frequency.

8. The vibration generator of claim 1, wherein the vibration generator has a volume that is less than three cubic centimeters.

9. The vibration generator of claim 1, wherein the counterweight is suspended by a flexible membrane.

10. The vibration generator of claim 1, wherein the input force signal is an electrical signal inputted to the speaker driver.

11. An electronic device comprising:

a communications circuit for receiving a communications transmission;

a vibration generator comprising a housing, a speaker driver mounted with respect to the housing, and a counterweight suspended with respect to the housing; and a controller configured to detect the received communications transmission and generate an input force signal to the speaker driver;

wherein the force inputted to the speaker driver is transmitted through an air medium surrounded by the housing of the vibration generator, and the speaker driver and air medium remain substantially rigid to transmit the input force through the air medium with minimal dissipation to cause the counterweight to provide a vibration alert to a user of the received communications transmission.

12. The electronic device of claim 11, wherein a resonance frequency of the speaker driver is greater than a frequency of the input force signal generated by the controller.

13. The electronic device of claim 12, wherein the frequency of the input force signal is less than 200 Hz.

14. The electronic device of claim 13, wherein the frequency of the input force signal is 160 Hz or less.

15. The electronic device of claim 14, wherein the resonance frequency of the speaker driver is at least 600 Hz.

16. The electronic device of claim 15, wherein the resonance frequency of the speaker driver is at least 800 Hz.

17. The electronic device of claim 11, wherein the vibration generator is a closed assembly and transmits the force inputted to the speaker driver through the air medium to the counterweight such that the speaker driver and the counterweight vibrate at substantially the same frequency.

18. The electronic device of claim 17, wherein the vibration frequency of the speaker driver and the counterweight is substantially the same as the frequency of the input force signal generated by the controller.

19. The electronic device of claim 11, wherein the input force signal generated by the controller is an electrical signal inputted to the speaker driver.

20. The electronic device of claim 10, wherein the electronic device is a mobile telephone.

* * * * *